US010755883B2

(12) United States Patent
Minowa et al.

(10) Patent No.: US 10,755,883 B2
(45) Date of Patent: Aug. 25, 2020

(54) ELECTROMAGNETIC RELAY

(71) Applicant: OMRON Corporation, Kyoto (JP)

(72) Inventors: Ryota Minowa, Kumamoto (JP); Shingo Mori, Kumamoto (JP); Toshiyuki Kakimoto, Shiga (JP); Kazuhiro Ikemoto, Kumamoto (JP)

(73) Assignee: Omron Corporation, Kyoto (JP)

( * ) Notice: Subject to any disclaimer, the term of this patent is extended or adjusted under 35 U.S.C. 154(b) by 108 days.

(21) Appl. No.: 16/220,725

(22) Filed: Dec. 14, 2018

(65) Prior Publication Data

US 2019/0122844 A1 Apr. 25, 2019

Related U.S. Application Data

(63) Continuation of application No. PCT/JP2017/023024, filed on Jun. 22, 2017.

(30) Foreign Application Priority Data

Jul. 29, 2016 (JP) ..... 2016-150292

(51) Int. Cl.
*H01H 3/60* (2006.01)
*H01H 50/58* (2006.01)
(Continued)

(52) U.S. Cl.
CPC ..... *H01H 50/58* (2013.01); *H01H 50/02* (2013.01); *H01H 50/14* (2013.01); *H01H 50/30* (2013.01);
(Continued)

(58) Field of Classification Search
CPC ..... H01H 50/58; H01H 50/02; H01H 50/30; H01H 50/14; H01H 50/36
(Continued)

(56) References Cited

U.S. PATENT DOCUMENTS 2,261,887 A * 11/1941 Menzel ..... H01H 51/20 335/106
5,245,881 A * 9/1993 Rometsch ..... F02N 15/067 335/131
(Continued)

FOREIGN PATENT DOCUMENTS

CN 1666309 A 9/2005
CN 105122414 A 12/2015
(Continued)

OTHER PUBLICATIONS

International Search Report issued in Application No. PCT/JP2017/023024, dated Sep. 26, 2017 (1 page).
(Continued)

*Primary Examiner* — Shawki S Ismail
*Assistant Examiner* — Lisa N Homza
(74) *Attorney, Agent, or Firm* — Osha Liang LLP

(57) ABSTRACT

An electromagnetic relay includes a housing, a pair of fixed terminals, a movable contactor that is movably disposed so as to approach and separate from a fixed contact placement surface of each of the pair of fixed terminals, a movable shaft capable of moving in conjunction with the movable contactor, electromagnetic drive unit that drives the movable shaft to move the movable contactor in a moving direction, and an attenuation mechanism unit that includes an insulating attenuation member disposed between the movable contactor and the electromagnetic drive unit, and a sound insulating gap provided between the attenuation member and the electromagnetic drive unit.

7 Claims, 7 Drawing Sheets

(51) Int. Cl.

| | |
|---|---|
| ***H01H 50/30*** | (2006.01) |
| ***H01H 50/02*** | (2006.01) |
| ***H01H 50/14*** | (2006.01) |
| ***H01H 50/36*** | (2006.01) |
| *H01H 50/54* | (2006.01) |
| *H01H 50/38* | (2006.01) |
| *H01H 9/44* | (2006.01) |

(52) U.S. Cl.
CPC ..... *H01H 50/36* (2013.01); *H01H 9/443* (2013.01); *H01H 50/305* (2013.01); *H01H 50/38* (2013.01); *H01H 50/546* (2013.01)

(58) Field of Classification Search
USPC ..... 335/193
See application file for complete search history.

(56) References Cited

U.S. PATENT DOCUMENTS 5,481,236 A * 1/1996 Ruehle ..... H01H 51/065 335/126
5,892,194 A * 4/1999 Uotome ..... H01H 1/34 218/68
6,911,884 B2 * 6/2005 Uotome ..... H01H 47/06 335/132
7,911,301 B2 * 3/2011 Yano ..... H01H 9/443 335/131
8,674,796 B2 * 3/2014 Ito ..... H01H 1/20 335/126
2004/0000981 A1 1/2004 Thrush et al.
2010/0289604 A1 * 11/2010 Kojima ..... H02H 9/001 335/133
2013/0057369 A1 * 3/2013 Yano ..... H01H 1/36 335/156
2013/0240495 A1 * 9/2013 Yano ..... H01H 9/36 219/123
2015/0022291 A1 * 1/2015 Kashimura ..... H01H 50/546 335/131
2015/0213982 A1 * 7/2015 Lim ..... H01H 1/54 335/185
2016/0093458 A1 * 3/2016 An ..... H01H 50/18 335/136
2016/0260566 A1 9/2016 Shima et al.
2017/0069452 A1 * 3/2017 Hiroki ..... H01H 9/443
2019/0013171 A1 * 1/2019 Minowa ..... H01H 50/44
2019/0035585 A1 * 1/2019 Minowa ..... H01H 50/42
2019/0122844 A1 * 4/2019 Minowa ..... H01H 50/02
2019/0131093 A1 * 5/2019 Minowa ..... H01H 50/645
2019/0131094 A1 * 5/2019 Minowa ..... H01H 50/443
2019/0131095 A1 * 5/2019 Minowa ..... H01H 1/502
2019/0131096 A1 * 5/2019 Minowa ..... H01H 50/641
2019/0131097 A1 * 5/2019 Minowa ..... H01H 50/04
2019/0148095 A1 * 5/2019 Minowa ..... H01H 50/42 335/185
2019/0304728 A1 * 10/2019 Minowa ..... H01H 50/58
2019/0304729 A1 * 10/2019 Minowa ..... H01H 50/14
2019/0311871 A1 * 10/2019 Minowa ..... H01H 50/546

FOREIGN PATENT DOCUMENTS

JP 2007-66807 A 3/2007
JP 5310936 B2 10/2013
JP 2015-46274 A 3/2015
WO 2015/136731 A1 9/2015

OTHER PUBLICATIONS

Written Opinion issued in International Application No. PCT/JP2017/023024 dated Sep. 26, 2017 (3 pages).
Office Action in counterpart Chinese Patent Application No. 201780035486.4 dated Jun. 5, 2019 (12 pages).

* cited by examiner

ELECTROMAGNETIC RELAY

BACKGROUND

Technical Field

The present invention relates to an electromagnetic relay.

Related Art

An electromagnetic relay disclosed in Patent Document 1 includes: a housing having a closed space inside; a pair of fixed terminals fixed to the housing electrically independently of each other; a plate-shaped movable contactor provided in the closed space, facing each of the pair of fixed terminals, and movable so as to approach or separate from each of the pair of fixed terminal; and an electromagnetic drive unit housed in the housing and disposed on a side opposite to the pair of fixed terminals across the movable contactor.

The electromagnetic relay further includes a movable shaft extending along the moving direction of the movable contactor and driven by the electromagnetic drive unit, and a magnet holder disposed between the movable contactor and the electromagnetic drive unit in the closed space and holding a pair of permanent magnets sandwiching the pair of fixed terminals. The movable shaft is provided with an annular guard portion that separates from the magnetic holder when the movable contactor approaches the pair of fixed terminals, and comes into contact with the magnetic holder when the movable contactor separates from the pair of fixed terminals, so as to restrict the movement of the movable shaft in a separating direction of the movable contactor.

Patent Document 1: Japanese Patent No. 5310936

SUMMARY

In the electromagnetic relay, a buffer material is disposed between the magnet holder and the electromagnetic drive unit to reduce a collision sound which is generated due to the annular guard portion of the movable shaft coming into contact with the magnetic holder when a state shifts from an operation state in which the pair of fixed terminals and the movable contactor are close to each other to a return state in which the pair of fixed terminals and the movable contactor are separated from each other.

However, in the electromagnetic relay, since the buffer material is disposed to reduce a collision sound, the number of parts increases. There has thus been a demand to reliably reduce a collision sound without increasing the number of parts.

One or more embodiments of the present invention provides an electromagnetic relay capable of reducing a collision sound that is generated when an operation state shifts to a return state without increasing the number of parts.

An electromagnetic relay according to one or more embodiments of the present invention includes: a box-shaped insulating housing in which a closed space is formed; a pair of fixed terminals fixed to the housing electrically independently of each other and each having a fixed contact placement surface in the closed space; a plate-shaped movable contactor having a conductivity, provided in the closed space, having a first surface which is a movable contact placement surface facing the fixed contact placement surface of the pair of fixed terminals, and movably disposed such that the first surface approaches and separates from each of the fixed contact placement surfaces of the pair of fixed terminals; a movable shaft that extends along a moving direction of the movable contactor to a second surface side of the movable contactor, opposite to the first surface, and is movable together with the movable contactor; an electromagnetic drive unit housed on the second surface side of the movable contactor in the housing, and driving the movable shaft to move the movable contactor forward and backward in the moving direction; and an attenuation member, provided in the closed space, including an insulating attenuation member disposed between the movable contactor and the electromagnetic drive unit, and a sound insulating gap provided between the attenuation member and the electromagnetic drive unit. The movable shaft includes a movement restricting unit that separates from the attenuation member as the movable contactor approaches the fixed contact placement surface, and comes into contact with the attenuation member after the separation of the movable contactor from the fixed contact placement surface, so as to restrict the movement of the movable shaft in a direction in which the movable contactor separates, and the attenuation member includes a collision sound attenuating unit configured to lengthen a path through which the collision sound propagates, rather than a path through which the collision sound propagates toward an outside of the housing in a state where the attenuation member and the electromagnetic drive unit are in contact without the sound insulating gap, the collision sound being generated due to the movement restricting unit of the movable shaft coming into contact with the attenuation member.

According to the electromagnetic relay of one or more embodiments of the present invention, there is provided the attenuation mechanism including the insulating attenuation member disposed between the movable contactor and the electromagnetic drive unit, and the sound insulating gap provided between the attenuation member and the electromagnetic drive unit. In addition, the attenuation member includes the collision sound attenuating unit configured to lengthen a path through which the collision sound propagates, rather than a path through which the collision sound propagates toward an outside of the housing in a state where the attenuation member and the electromagnetic drive unit are in contact without the sound insulating gap, the collision sound having been generated due to the movement restricting unit of the movable shaft coming into contact with the attenuation member. It may thereby be possible to reduce a collision sound that is generated when the movable contactor separates from the pair of fixed terminals without increasing the number of parts.

DETAILED DESCRIPTION

Hereinafter, embodiments of the present invention will be described with reference to the accompanying drawings. In the following description, terms (e.g., terms including "upper", "lower", "right", "left", "side", and "end") indicating specific directions or positions are used as necessary, but the use of these terms is for facilitating understanding of the invention with reference to the drawings, and the technical scope of the present invention is not limited by the meaning of these terms. The following description is merely exemplary in nature and not intended to limit the present invention, its application, or its usage. Further, the drawings are schematic, and ratios of dimensions or the like do not necessarily agree with actual ones. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
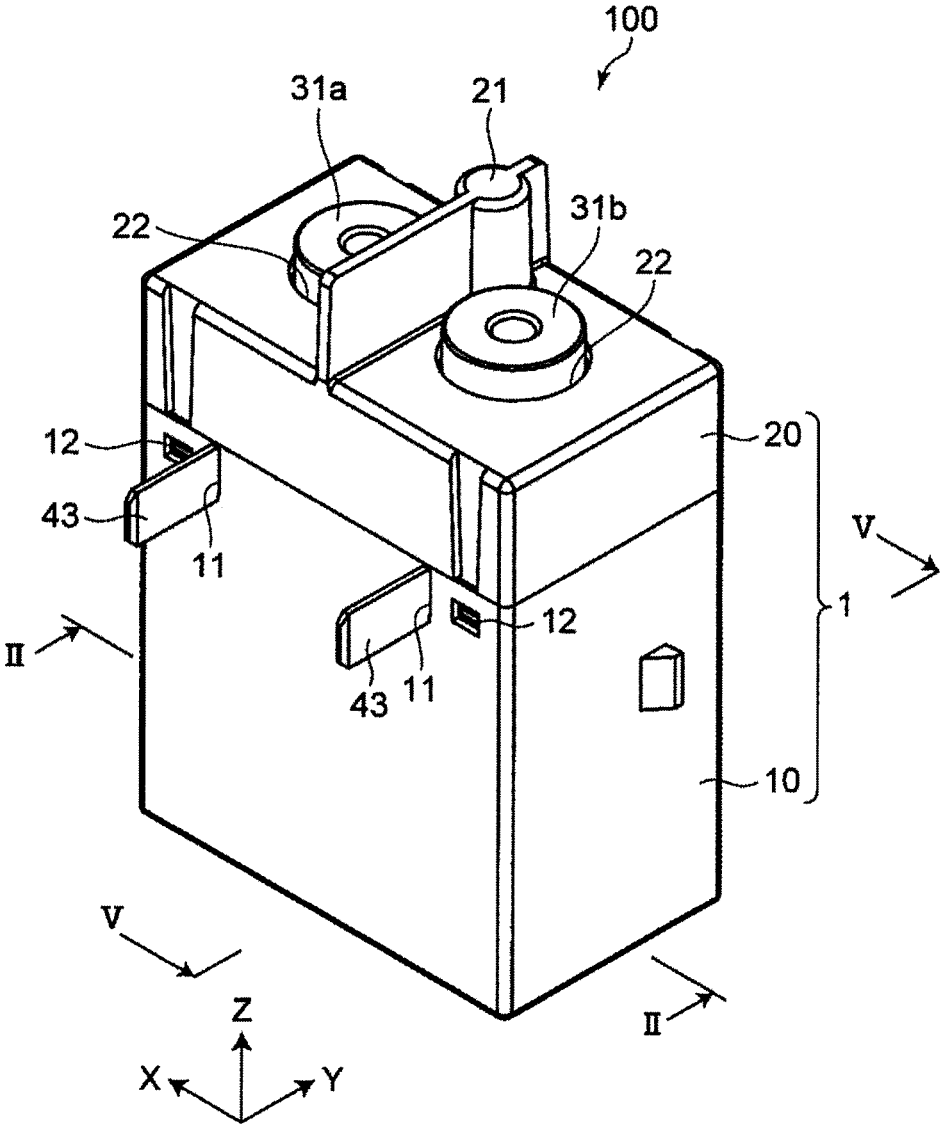
FIG. 1 is a perspective view illustrating an electromagnetic relay of one or more embodiments of the present invention.
Figure 2:
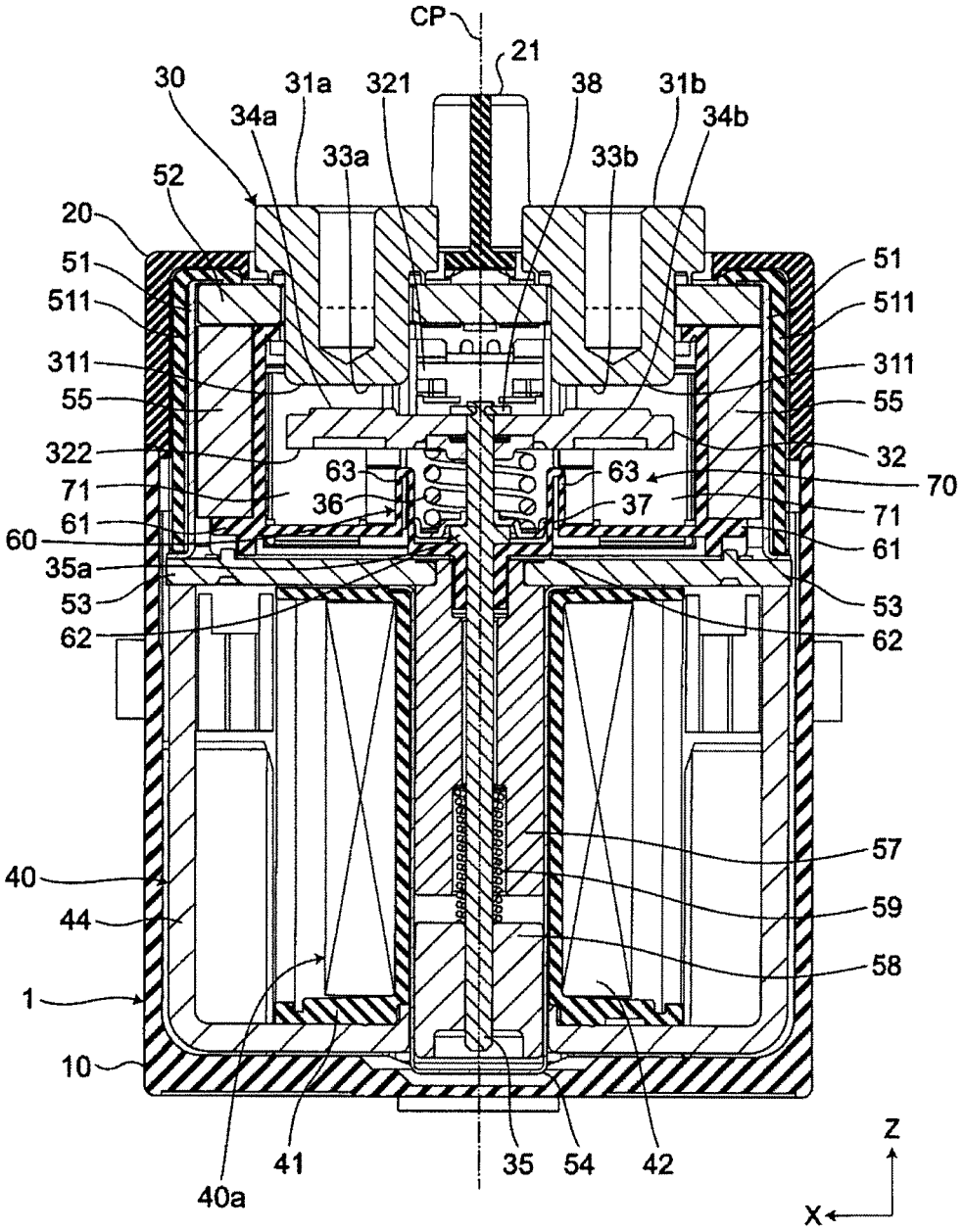
FIG. 2 is a sectional view taken along line II-II of the electromagnetic relay of FIG. 1 in a return state.

As illustrated in FIG. 1, an electromagnetic relay 100 of one or more embodiments of the present invention includes an insulating housing 1 and a pair of fixed terminals 31*a*, 31*b* fixed to the housing 1. As illustrated in FIG. 2, the electromagnetic relay 100 is symmetrically arranged with respect to a plane CP passing through the centers of a pair of fixed terminals 31*a*, 31*b* and extending in a direction orthogonal to the arrangement direction of the pair of fixed terminals 31*a*, 31*b*.

Figure 3:
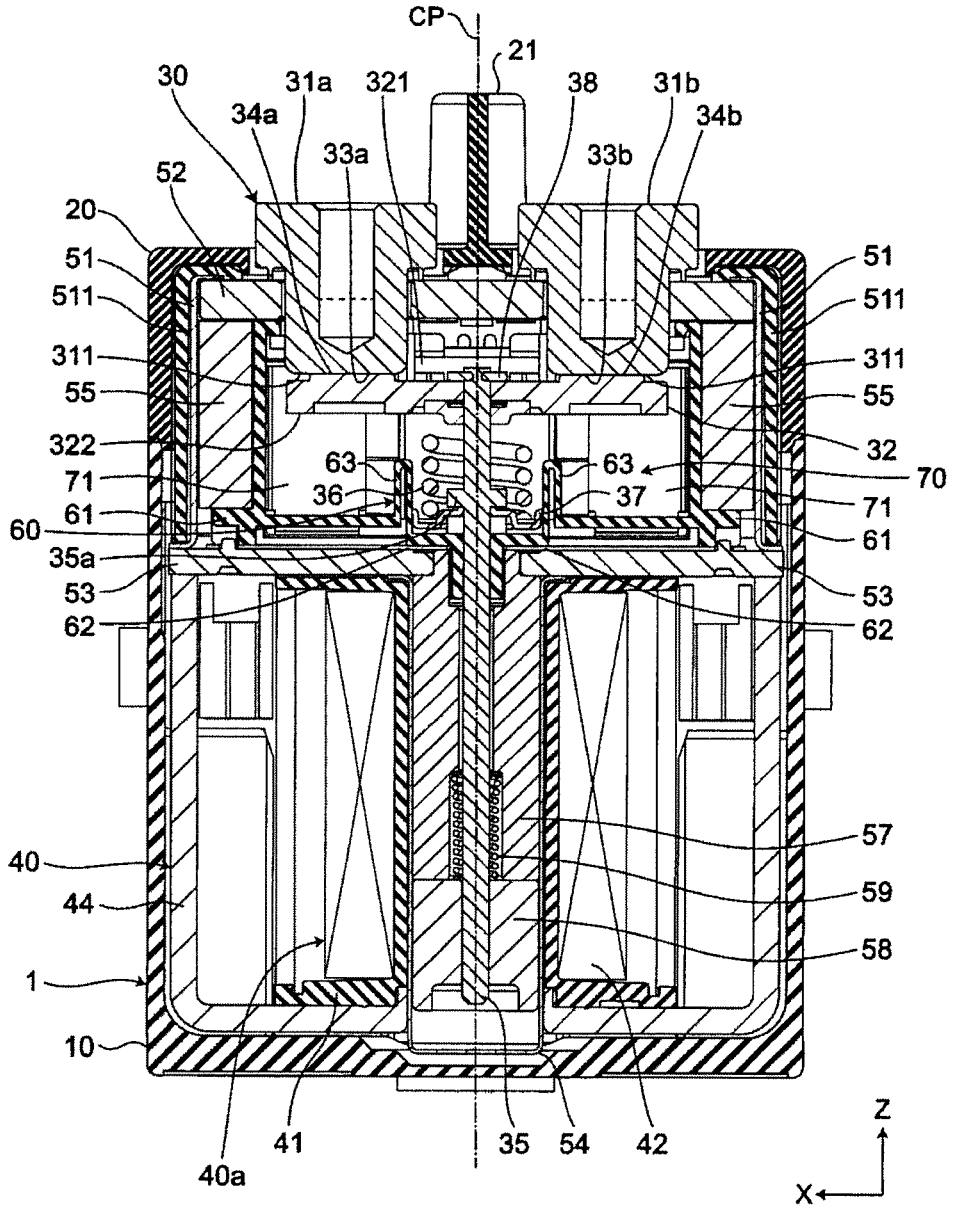
FIG. 3 is a sectional view taken along line II-II of the electromagnetic relay of FIG. 1 in an operation state.

As illustrated in FIGS. 2 and 3, a closed space 70 is formed inside the housing 1, and the electromagnetic relay 100 includes in the closed space 70 a conductive plate-shaped movable contactor 32 so as to face the pair of fixed terminals 31*a*, 31*b*. The movable contactor 32 is movably disposed so as to approach and separate from a fixed contact placement surface 311 of each of the pair of fixed terminals 31*a*, 31*b*.

The electromagnetic relay 100 includes a movable shaft 35 provided in the closed space 70 and movable together with the movable contactor 32, an electromagnetic drive unit 40 accommodated on the side opposite to the pair of fixed terminals 31*a*, 31*b* across the movable contactor 32 in the housing 1, and an attenuation mechanism unit 60 provided in the closed space 70.

FIG. 2 illustrates the electromagnetic relay 100 in a return state in which the movable contactor 32 is separated from the fixed contact placement surface 311 of each of the pair of fixed terminals 31*a*, 31*b*. FIG. 3 illustrates the electromagnetic relay 100 in an operation state in which the movable contactor 32 is close to the fixed contact placement surface 311 of each of the pair of fixed terminals 31*a*, 31*b*.

A direction in which the pair of fixed terminals 31*a*, 31*b* are arranged (i.e., a horizontal direction in FIG. 2) is defined as an X direction, and a height direction of the electromagnetic relay 100 (i.e., a vertical direction in FIG. 2) is defined as a Z direction. Further, a direction orthogonal to the X and Z directions is defined as a Y direction.

As illustrated in FIGS. 2 and 3, the housing 1 is made up of a case 10, a cover 20, and a closed space forming portion 30 that forms the closed space 70 provided inside the case 10 and the cover 20.

As illustrated in FIG. 1, the case 10 has a rectangular box shape. Further, as illustrated in FIG. 2, the case 10 has an opening on the upper side in the Z direction.

As illustrated in FIG. 1, the side surface of the case 10 in the Y direction is provided with a terminal groove 11 in which a coil terminal 43 protrudes, and a latching hole 12 for fixing the case 10 and the cover 20.

As illustrated in FIG. 1, the cover 20 has a rectangular box shape and is attached so as to cover the opening of the case 10. Further, as illustrated in FIGS. 2 and 3, the cover 20 has an opening on the lower side in the Z direction.

The upper surface of the cover 20 is provided with a partition wall 21 which is provided substantially at the center in the X direction and extends in the Y direction. Terminal holes 22, in which the pair of fixed terminals 31*a*, 31*b* protrude, are respectively provided on both sides of the partition wall 21 in the X direction. Although not illustrated, the opening of the cover 20 is provided with latching pawls for fixing the case 10 and the cover 20 together with the latching holes 12 of the case 10.

As illustrated in FIGS. 2 and 3, the closed space forming portion 30 is made up of an insulating quadrilateral ceramic plate 52 along an XY plane, a quadrangular cylindrical flange 51 extending downward in the Z direction from the edge of the ceramic plate 52, a plate-shaped first yoke 53 disposed at the lower end of the flange 51 along the XY plane, a circular or square bottomed cylindrical body 54 extending downward in the Z direction from the vicinity of the flat surface of the first yoke 53. The flange 51, the ceramic plate 52, and the first yoke 53 are integrated, and the first yoke 53 and the bottomed cylindrical body 54 are joined hermetically.

The flange 51 has an opening at each of the upper and lower ends in the Z direction and has an insulating inner cover 511 covering the outer periphery thereof.

The ceramic plate 52 is disposed so as to close the opening on the upper of the flange 51 in the Z direction. The ceramic plate 52 is provided with a pair of terminal holes 521 arranged so as to face the terminal holes 22 of the cover 20. The pair of fixed terminals 31*a*, 31*b* are inserted into the respective terminal holes 521 and fixed by brazing.

The first yoke 53 extends along the XY plane and is disposed so as to close the opening on the lower of the flange 51 in the Z direction. A hole portion 531 is provided on the flat surface of the first yoke 53. A substantially cylindrical movable shaft 35 is movably inserted in the hole portion 531. The first yoke 53 constitutes a part of the closed space forming portion 30 and constitutes a part of the electromagnetic drive unit 40.

The flanged bottomed cylindrical body 54 extends from the first yoke 53 to the bottom of the case 10 and is disposed so as to cover the hole portion 531 of the first yoke 53. The bottomed cylindrical body 54 accommodates inside the movable shaft 35, a fixed iron core 57 fixed to the first yoke 53, and a movable iron core 58 fixed to the lower end of the movable shaft 35. Between the fixed iron core 57 and the movable iron core 58, a return spring 59 is provided to urge the movable iron core 58 downward in the Z direction. The fixed iron core 57, the movable iron core 58, and the return spring 59 constitute a part of the electromagnetic drive unit 40.

The fixed iron core 57 extends along the bottomed cylindrical body 54 from the edge of the hole portion 531 of the first yoke 53 toward the lower side in the Z direction. The center of the fixed iron core 57 is provided with a through hole through which the movable shaft 35 can move up and down in the Z direction. As illustrated in FIG. 2, in a state where the pair of fixed contacts 33*a*, 33*b* and the pair of movable contacts 34*a*, 34*b* are separated, a gap is formed between the fixed iron core 57 and the movable iron core 58.

As illustrated in FIGS. 2 and 3, each of the pair of fixed terminals 31*a*, 31*b* has a substantially cylindrical shape and is fixed to the ceramic plate 52, constituting the housing 1, electrically independently of each other. The pair of fixed terminals 31*a*, 31*b* are arranged at intervals along a first direction (i.e., the X direction) which is the arrangement direction thereof, and a part of each of the fixed terminals 31*a*, 31*b* is located in the closed space 70.

A fixed contact placement surface 311 along the XY plane is provided on the end face in the closed space 70 of the pair of fixed terminals 31*a*, 31*b* (i.e., the end face at the end of the lower side in the Z direction). Fixed contacts 33*a*, 33*b* are provided on the fixed contact placement surfaces 311, respectively. The respective fixed contacts 33*a*, 33*b* may be formed integrally with the corresponding fixed terminals 31*a*, 31*b*, or may be formed separately from the corresponding fixed terminals 31*a*, 31*b*.

As illustrated in FIGS. 2 and 3, the movable contactor 32 has a first surface 321 along the XY plane which faces the pair of fixed terminals 31*a*, 31*b*, and a second surface 322 along the XY plane on the side opposite to the first surface 321.

A pair of movable contacts 34*a*, 34*b* are provided on the first surface 321 of the movable contactor 32. That is, the first surface 321 is a movable contact placement surface, and the pair of movable contacts 34*a*, 34*b* are electrically connected to each other by the movable contactor 32. The pair of movable contacts 34*a*, 34*b* are arranged to face the pair of fixed contacts 33*a*, 33*b*, respectively. The movable contacts 34*a*, 34*b* may be formed integrally with the movable contactor 32 or may be formed separately from the movable contactor 32.

As illustrated in FIGS. 2 and 3, the movable shaft 35 extends from a second surface 322 of the movable contactor 32 along the moving direction of the movable contactor 32 (i.e., the Z direction), and its upper end (the end on the upper side in the Z direction) is connected to the movable contactor 32 via a retaining ring 38. That is, the movable shaft 35 is located on the second surface side of the movable contactor 32 and is movable together with the movable contactor 32.

The movable iron core 58 is fixed to the lower end of the movable shaft 35 (i.e., the end on the lower side in the Z direction), and in an intermediate portion of the movable shaft 35, an annular guard portion 35*a* as an example of a movement restricting unit is provided extending over the entire circumference of the movable shaft 35. The guard portion 35*a* protrudes from the movable shaft 35 along the XY plane, and separates from the attenuation member 61 as the movable contactor 32 approaches the fixed contact placement surface 311. After the movable contactor 32 separating from the contact placement surface 311, the guard portion 35*a* comes into contact with an attenuation member 61. This restricts the movement of the movable shaft 35 in the direction in which the movable contactor 32 separates.

Between the annular guard portion 35*a* and the movable contactor 32, a coil spring 36 having a movable shaft 35 disposed at the center, and a spring tray 37 are provided, the spring tray 37 being held by the annular guard portion 35*a* and sandwiching the coil spring 36 together with the movable contactor 32. The movable contactor 32, the movable shaft 35, the coil spring 36, and the spring tray 37 are integrally movable in the Z direction.

As illustrated in FIGS. 2 and 3, the electromagnetic drive unit 40 is made up of an electromagnet portion 40*a* surrounding the outer periphery of the bottomed cylindrical body 54, a first yoke 53 and a second yoke 44 surrounding the electromagnet portion 40*a* in the X direction and the Z direction, a fixed iron core 57 fixed to the first yoke 53 in the closed space 70, and a movable iron core 58 fixed to the lower end of the movable shaft 35 in the Z direction.

The electromagnet portion 40*a* is made up of an insulating spool 41, a coil 42 wound around the spool 41, and the coil terminal 43 (illustrated in FIG. 1) fixed to the spool 41. When a voltage is applied to the coil 42 of the electromagnet portion 40*a*, the movable iron core 58 is attracted to the fixed iron core 57, and moves the movable shaft 35 up and down along the Z direction. This causes the movable contactor 32 to approach or separate from the fixed contact placement surface 311 of each of the pair of fixed terminals 31*a*, 31*b*. That is, the electromagnetic drive unit 40 drives the movable shaft 35 to move the movable contactor 32 forward and backward in the moving direction (i.e., the Z direction).

The second yoke 44 has a substantially U shape in a sectional view along the XZ plane, and both ends of the second yoke 44 are fixed to the first yoke 53.

As illustrated in FIGS. 2 and 3, the attenuation mechanism unit 60 includes an insulating attenuation member 61 disposed between the movable contactor 32 and the electromagnetic drive unit 40, and a sound insulating gap 62 provided between the attenuation member 56 and the electromagnetic drive unit 40.

Figure 4:
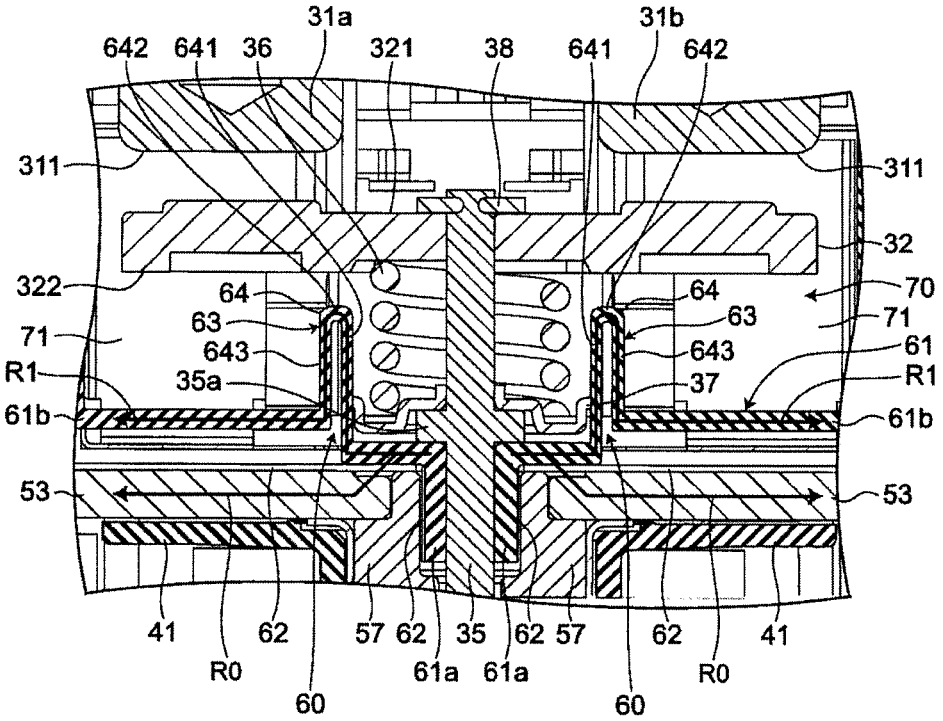
FIG. 4 is a partially enlarged view of FIG. 2.
Figure 5:
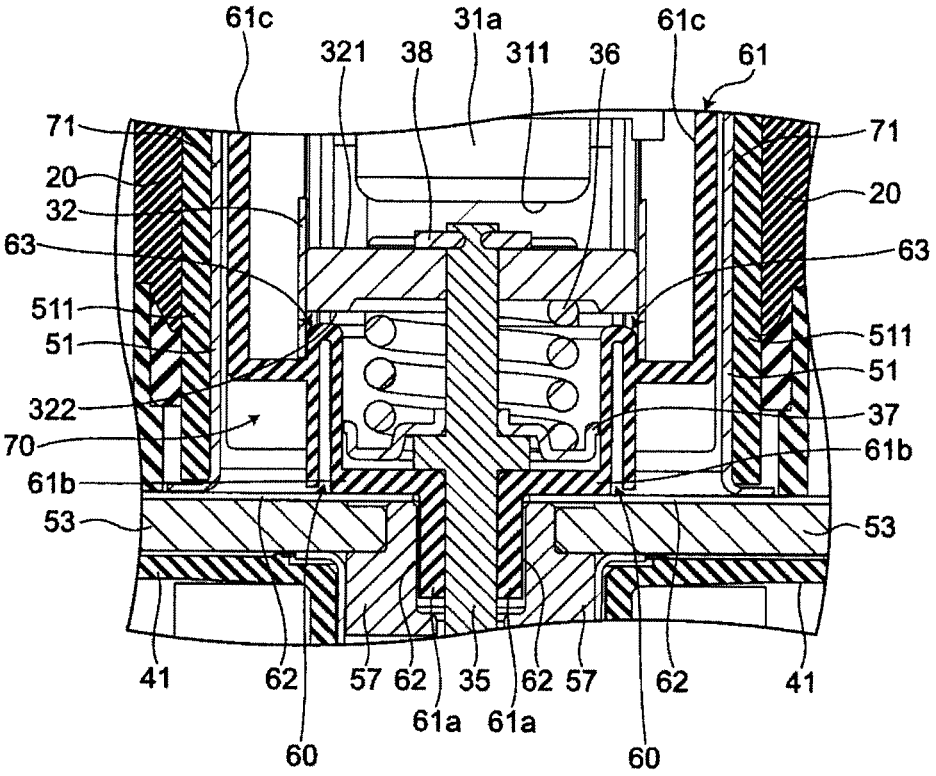
FIG. 5 is a partially enlarged view of a sectional view taken along line V-V of FIG. 1.

More specifically, as illustrated in FIGS. 4 and 5, the attenuation member 61 includes a first vertical cylindrical portion 61*a* extending downward from the annular guard portion 35*a* along the movable shaft 35, a guard portion 61*b* laterally projecting from the upper end of the first vertical cylindrical portion 61*a* to the vicinity of the flange 51 along the first yoke 53, and a second vertical cylindrical portion 61*c* extending from the vicinity of the flange 51 of the guard portion 61*b* to the ceramic plate 52 along the flange 51 (only illustrated in FIG. 5). The attenuation member 61 and the annular guard portion 35*a* of the movable shaft 35 come into contact with each other at the upper end of the first vertical cylindrical portion 61*a*. Note that the movable shaft 35 is movable upward and downward in the Z direction with respect to the first vertical cylindrical portion 61*a*.

The sound insulating gap 62 is provided between the guard portion 61*b* and the first yoke 53 as well as the fixed iron core 57 of the electromagnetic drive unit 40 and between the first vertical cylindrical portion 61*a* and the fixed iron core 57 of the electromagnetic drive unit 40.

Further, a collision sound attenuating unit 63 is provided on the guard portion 61*b* of the attenuation member 61. As illustrated in FIG. 4, the collision sound attenuating unit 63 is configured to lengthen a path R1 through which the collision sound propagates, rather than a path R0 through which the collision sound propagates toward the outside of the housing 1 in a state where the attenuation member 61 and the first yoke 53 and/or the fixed iron core 57 of the electromagnetic drive unit 40 are in contact without the sound insulating gap 62, the collision sound having been generated due to the annular guard portion 35*a* of the movable shaft 35 coming into contact with the attenuation member 61. This makes it possible to demonstrate the attenuation effect of the collision sound.

Specifically, the collision sound attenuating unit 63 includes a meandering portion 64 that has a U shape in a sectional view along the moving direction of the movable contactor 32 (i.e., Z direction) and causes the path R1, through which the collision sound propagates, to meander. The meandering portion 64 is made up of a first peripheral wall portion 641 extending along the movable shaft 35 upward in the Z direction from the guard portion 61*b* extending in a direction intersecting with the moving direction (i.e., the Z direction) of the movable contactor 32 of the attenuation member 61, a connection wall portion 642 extending in a direction intersecting with the movable shaft 35 (i.e., along the XY plane) from the end distant from the guard portion 61*b* of the first peripheral wall portion 641, and a second peripheral wall portion 643 extending in a direction opposite to the first peripheral wall portion 640 (i.e., downward in the Z direction) along the movable shaft 35 from an end distant from the first peripheral wall portion 641 of the connection wall portion 642.

A pair of permanent magnets 55, 55 and an arc shielding member 71 are provided in the closed space 70 of the housing 1.

The pair of permanent magnets 55, 55 face each other and are disposed at both ends in the X direction inside the flange 51 so as to sandwich the pair of fixed contacts 33*a*, 33*b* and the pair of movable contacts 34*a*, 34*b*. The pair of permanent magnets 55, 55 are held by the attenuation member 61.

The arc shielding member 71 is disposed so as to cover both sides of the pair of fixed contacts 33*a*, 33*b* and the pair of movable contacts 34*a*, 34*b* in the Y direction (the rear side and the front side in FIG. 2), and the outside thereof in the X direction (i.e., the side closer to the adjacent permanent magnets 55).

Next, the operation of the electromagnetic relay 100 will be described with reference to FIGS. 2 and 3.

In the electromagnetic relay 100 in a return state in which no voltage is applied to a coil 42 of the electromagnet portion 40*a*, as illustrated in FIG. 2, the annular guard portion 35*a* of the movable shaft 35 and the attenuation member 61 of the attenuation mechanism unit 60 are in contact with each other, and the pair of fixed terminals 31*a*, 31*b* and the movable contactor 32 are separated. At this time, the movable iron core 58 fixed to the tip of the movable shaft 35 is urged toward the lower side in the Z direction by the return spring 59.

When a voltage is applied to the coil 42 of the electromagnetic drive unit 40 of the electromagnetic relay 100 in the return state, the movable iron core 58 is magnetically attracted to the fixed iron core 57 and moves upward in the Z direction against the spring force of the return spring 59. As the movable iron core 58 moves, the movable shaft 35 moves upward in the Z direction to move the movable contactor 32 upward in the Z direction via the coil spring 50, and the first surface 321 of the movable contactor 32 approaches the pair of fixed terminals 31*a*, 31*b*. As the movable contactor 32 approaches the pair of fixed terminals 31*a*, 31*b*, the pair of movable contacts 34*a*, 34*b* provided on the first surface 321 of the movable contactor 32 respectively come into contact with the corresponding fixed contacts 33*a*, 33*b*.

When the application of the voltage to the coil 42 of the electromagnetic relay 100 in the operation state is stopped, the magnetic attraction force of the fixed iron core disappears, and the movable iron core 58 is urged toward the lower side in the Z direction by the spring force of the return spring 59. The movable shaft 35 moves toward the lower side in the Z direction by the urging force of the movable iron core 58, the movable contactor 32 is moved downward in the Z direction via the coil spring 50, and the first surface 321 of the movable contactor 32 is separated from the pair of fixed terminals 31*a*, 31*b*. As illustrated in FIG. 2, as the movable contactor 32 separates from the pair of fixed terminals 31*a*, 31*b*, the pair of movable contacts 34*a*, 34*b* provided on the first surface 321 of the movable contactor 32 are separated from the pair of fixed contacts 33*a*, 33*b*, respectively.

As described above, when the electromagnetic relay 100 shifts the state from the operation state to the return state, the annular guard portion 35*a* of the movable shaft 35 comes into contact with the attenuation member 61 of the attenuation mechanism unit 60 to generate a collision sound. For example, when the attenuation member 61 is in contact with the fixed iron core 57 and the first yoke 53 of the electromagnetic drive unit 40, the generated collision sound propagates from the attenuation member 61 to the fixed iron core 57 and the first yoke 53, and is then headed toward the outside of the housing 1. That is, the collision sound linearly propagates along the path R0 illustrated in FIG. 4.

The electromagnetic relay 100 is provided with the attenuation mechanism unit 60 including the insulating attenuation member 61 disposed between the movable contactor 32 and the fixed iron core 57 and the first yoke 53 of the electromagnetic drive unit 40, and the sound insulating gap 62 provided between the attenuation member 61 and the fixed iron core 57 and the first yoke 53 of the electromagnetic drive unit 40. Further, the electromagnetic relay 100 is provided with the collision sound attenuating unit 63 configured to lengthen the path through which the collision sound propagates, rather than the path R0 through which the collision sound propagates toward the outside of the housing 1 in a state where the attenuation member 61 and fixed iron core 57 as well as the first yoke 53 are in contact without the sound insulating gap 62, the collision sound having been generated due to the annular guard portion 35*a* of the movable shaft 35 coming into contact with the attenuation member 61. As a result, the collision sound propagates through the attenuation member 61 without propagating to the fixed iron core 57 and the first yoke 53 of the electromagnetic drive unit 40 by the sound insulating gap 62, the collision sound being generated when the movable contactor 32 separates from the fixed contact placement surface 311 of each of the pair of fixed terminals 31*a*, 31*b* and the annular guard portion 35*a* and the attenuation member 61 come into contact with each other. The collision sound having propagated through the attenuation member 61 is attenuated by the collision sound attenuating unit 63 before reaching the outside of the housing 1. That is, it is possible to reduce the collision sound generated when the movable contactor 32 separates from the pair of fixed terminals 31*a*, 31*b* without increasing the number of parts.

In addition, the collision sound attenuating unit 63 has a U shape in a sectional view along the moving direction of the movable contactor 32 (i.e., the Z direction) and includes the meandering portion 64 causing the path R1, through which a collision sound propagates, to meander. It is thus possible to lengthen a path R1 through which the collision sound propagates, rather than the path R0 through which the collision sound propagates from the attenuation member 61 toward the outside of the housing 1 via the fixed iron core 57 and the first yoke 53 in a state where the attenuation member 61 and the fixed iron core 57 and the first yoke 53 are in contact without the sound insulating gap 62, the collision sound having been generated due to the annular guard portion 35*a* of the movable shaft 35 coming into contact with the attenuation member 61.

Generally, at the time of opening and closing a pair of fixed contacts and a pair of movable contacts, the powder of the contact melted by heat of arc scatters (the powder of the scattered contact is hereinafter referred to as scattered powder) associated with contact and separation of the pair of fixed contacts and the pair of movable contacts, the arc being generated between the pair of fixed contacts and the pair of movable contacts. When this scattered powder adheres to and accumulates on the movable shaft 35 and the coil spring 36, the movable contactor 32 cannot be operated as designed, and the contact reliability between the fixed contacts 33*a*, 33*b* and the movable contacts 34*a*, 34*b* might deteriorate.

In the electromagnetic relay 100, the meandering portion 64 includes the first peripheral wall portion 641 extending upward in the Z direction along the movable shaft 35 from the guard portion 61*b* of the attenuation member 61, the connection wall portion 642 extending along the XY plane from the end distant from the guard portion 61*b* of the first peripheral wall portion 641, and the second peripheral wall portion 643 extending downward in the Z direction along the movable shaft 35 from the end distant from the first peripheral wall portion 641 of the connection wall portion 642. This makes it possible to reduce accumulation of scattered powder on the movable shaft 35 and the coil spring 36, which is generated as the fixed contact 33*a* and the movable contact 49*a* come into contact and separate. As a result, it is possible to prevent deterioration in contact reliability between the fixed contacts 33*a*, 33*b* and the movable contacts 34*a*, 34*b* by operating the movable contactor 32 as designed.

In the electromagnetic relay 100 according to one or more embodiments of the present invention, the collision sound attenuating unit 63 includes the meandering portion 64 made up of the first peripheral wall portion 641, the connection wall portion 642, and the second peripheral wall portion 643, but this is not restrictive. The collision sound attenuating unit 63 may only be configured such that the path R1 through which the collision sound propagates via the attenuation member 61 is longer than the path R0 in the case of absence of the sound insulating gap 62, namely, the path R0 through which the collision sound propagates toward the outside of the housing 1 in a state where the attenuation member 61 and the electromagnetic drive unit 40 are in contact with each other. That is, the meandering portion 64 may be omitted if possible.

Figure 6:
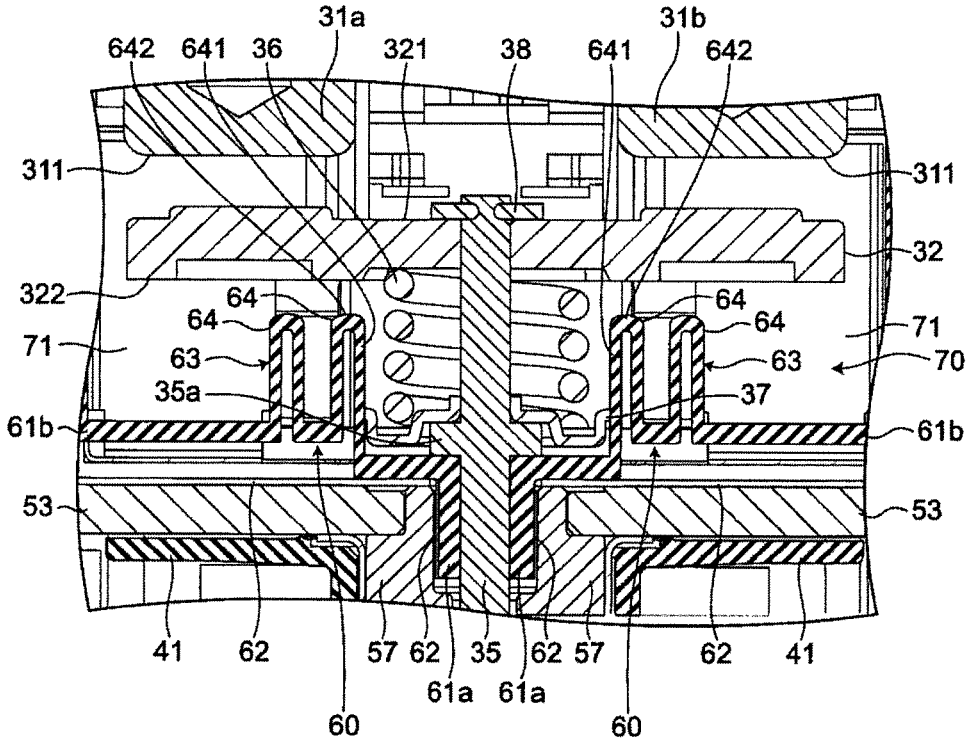
FIG. 6 is a partially enlarged view of a sectional view taken along line II-II of FIG. 1 illustrating another example of a collision sound attenuating unit of the electromagnetic relay of FIG. 1.

In addition, the collision sound attenuating unit 63 is not limited to one meandering portion 64, but may, for example, include a plurality of meandering portions 64 linearly coupled in series to each other as illustrated in FIG. 6. In this manner, by providing a plurality of meandering portions as the collision sound attenuating unit, it is possible to more reliably reduce the collision sound generated when the movable contactor is separated from the pair of fixed terminals.

Figure 7:
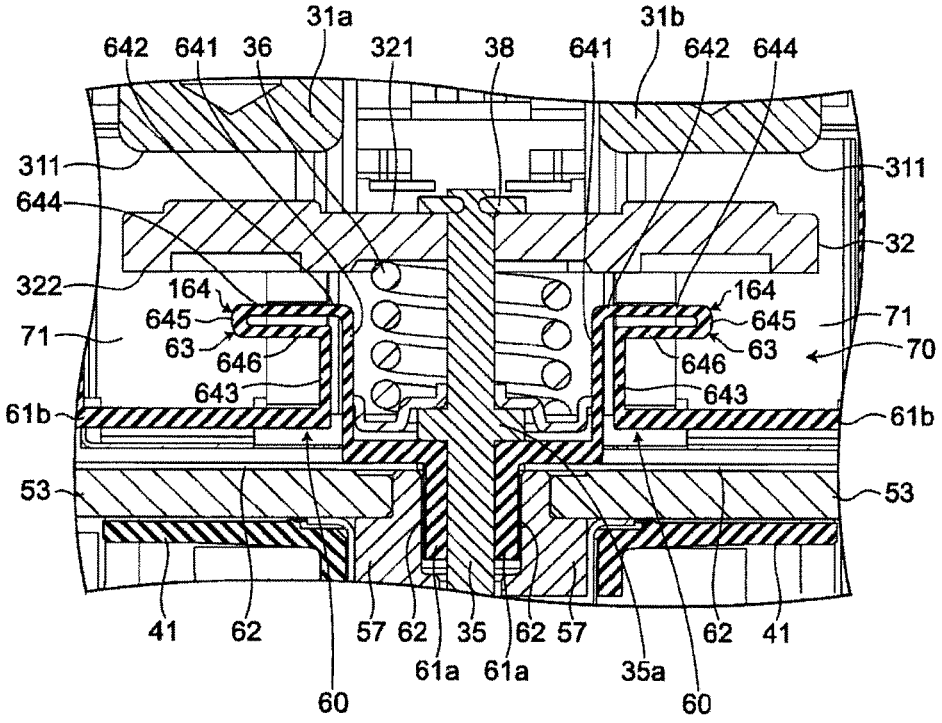
FIG. 7 is a partially enlarged view of a sectional view taken along the line II-II of FIG. 1 illustrating another example of the collision sound attenuating unit of the electromagnetic relay of FIG. 1.

Further, the collision sound attenuating unit 63 is not limited to the meandering portion 64 made up of the first peripheral wall portion 641, the connection wall portion 642, and the second peripheral wall portion 643. For example, as illustrated in FIG. 7, the collision sound attenuating unit 63 may include one or more meandering portions 164 made up of the first peripheral wall portion 641, the connection wall portion 642, a third peripheral wall portion 644 extending on the extended line of the connection wall portion 642, a connection wall portion 645 extending downward in the Z direction from the end on the outer side of the third peripheral wall portion 644 in the X direction (i.e., the farther end from the movable shaft 35), and a fourth peripheral wall portion 646 extending parallel to the third peripheral wall portion 644 from the lower end of the connection wall portion 645 to be coupled to the second peripheral wall portion 643. That is, it is possible to adopt a collision sound attenuating unit having a freely selected shape and structure in accordance with the design of the electromagnetic relay.

In addition, the sound insulating gap 62 is provided in a position at least closer to the movable shaft 35 than the collision sound attenuating unit 63 in the direction (i.e., along the XY plane) intersecting with the moving direction of the movable contactor 32 (i.e., the Z direction), so that it is possible to more reliably reduce the collision sound generated when the movable contactor separates from the pair of fixed terminals.

A variety of embodiments of the present invention have been described in detail with reference to the drawings, and lastly, a variety of aspects of the present invention will be described.

An electromagnetic relay of a first aspect of the present invention includes: a box-shaped insulating housing in which a closed space is formed; a pair of fixed terminals fixed to the housing electrically independently of each other and each having a fixed contact placement surface in the closed space; a plate-shaped movable contactor having a conductivity, provided in the closed space, having a first surface which is a movable contact placement surface facing the fixed contact placement surface of the pair of fixed terminals, and movably disposed such that the first surface approaches and separates from each of the fixed contact placement surfaces of the pair of fixed terminals; a movable shaft that extends along a moving direction of the movable contactor to a second surface side of the movable contactor, opposite to the first surface, and is movable together with the movable contactor; an electromagnetic drive unit housed on the second surface side of the movable contactor in the housing, and driving the movable shaft to move the movable contactor forward and backward in the moving direction; and an attenuation mechanism, provided in the closed space, including an insulating attenuation member disposed between the movable contactor and the electromagnetic drive unit, and a sound insulating gap provided between the attenuation member and the electromagnetic drive unit. The movable shaft includes a movement restricting unit that separates from the attenuation member as the movable contactor approaches the fixed contact placement surface, and comes into contact with the attenuation member after the separation of the movable contactor from the fixed contact placement surface, so as to restrict the movement of the movable shaft in a direction in which the movable contactor separates, and the attenuation member includes a collision sound attenuating unit configured to lengthen a path through which the collision sound propagates, rather than a path through which the collision sound propagates toward an outside of the housing in a state where the attenuation member and the electromagnetic drive unit are in contact without the sound insulating gap, the collision sound being generated due to the movement restricting unit of the movable shaft coming into contact with the attenuation member.

According to the electromagnetic relay of the first aspect, the attenuation mechanism is provided which includes the insulating attenuation member disposed between the movable contactor and the electromagnetic drive unit and the sound insulating gap provided between the attenuation member and the electromagnetic drive unit. In addition, the attenuation member includes the collision sound attenuating unit configured to lengthen a path through which the collision sound propagates, rather than a path through which the collision sound propagates toward an outside of the housing in a state where the attenuation member and the electromagnetic drive unit are in contact without the sound insulating gap, the collision sound being generated due to the movement restricting unit of the movable shaft coming into contact with the attenuation member. As a result, the collision sound propagates through the attenuation member without propagating to the fixed iron core or the first yoke of the electromagnetic drive unit by the sound insulating gap, the collision sound being generated when the movable contactor separates from the fixed contact placement surface of each of the pair of fixed terminals and the movement restricting unit of the movable shaft and the attenuation member come into contact with each other. The collision sound having propagated through the attenuation member is attenuated by the collision sound attenuating unit before reaching the outside of the housing. That is, it is possible to reduce the collision sound generated when the movable contactor separates from the pair of fixed terminals.

In an electromagnetic relay of a second aspect of the present invention, the sound insulating gap is provided at a position closer to the movable shaft than the collision sound attenuating unit in a direction intersecting with the moving direction of the movable contactor.

According to the electromagnetic relay of the second aspect, it is possible to reduce a collision sound that is generated when the movable contactor separates from the pair of fixed terminals.

In the electromagnetic relay according to a third aspect of the present invention, the collision sound attenuating unit has a U shape in a sectional view taken along the moving direction of the movable contactor and has a meandering portion meandering a path through which the collision sound propagates.

According to an electromagnetic relay of the third aspect, it is possible to lengthen a path through which a collision sound propagates, rather than a path through which the collision sound propagates toward an outside of the housing in a state where the attenuation member and the electromagnetic drive unit are in contact without the sound insulating gap, the collision sound being generated due to the movement restricting unit of the movable shaft coming into contact with the attenuation member.

In an electromagnetic relay of a fourth aspect of the present invention, the attenuation member is made up of the meandering portion and a guard portion extending in a direction intersecting with the moving direction of the movable contactor and, the meandering portion includes a first peripheral wall portion extending along the movable shaft from the guard portion of the attenuation member, a connection wall portion extending in a direction intersecting with the movable shaft from a farther end of the first peripheral wall portion, remote from the guard portion, and a second peripheral wall portion extending along the movable shaft from a farther end of the connection wall portion from the first peripheral wall portion, in a direction opposite to the first peripheral wall portion According to the electromagnetic relay of the fourth aspect, it is possible to reduce accumulation of scattered powder around the driving axis, which is generated in association with approach to or separation from the fixed contact placement surfaces of the pair of fixed terminals of the movable contactor. As a result, it is possible to operate the movable contactor as designed, and to prevent deterioration in contact reliability.

In an electromagnetic relay of a fifth aspect of the present invention, the collision sound attenuating unit includes a plurality of the meandering portions connected in series to each other.

According to the electromagnetic relay of the fifth aspect, it is possible to reliably reduce the collision sound that is generated when the movable contactor separates from the pair of fixed terminals.

By appropriately combining freely selected embodiments or modified examples of the above variety of embodiments or modified examples, the respective effects of those combined can be exerted. While it is possible to combine embodiments, combine examples, or combine an embodiment and an example, it is also possible to combine features in different embodiments or examples.

While the present invention has been fully described in connection with embodiments with reference to the accompanying drawings, a variety of modified examples or corrections will be apparent to those skilled in the art. Such modifications or amendments are to be understood as being included in the scope of the present invention according to the appended claims so long as not deviating therefrom.

The electromagnetic relay of the present invention is not limited to the above embodiments, but can be applied to other electromagnetic relays.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

1 housing
10 case
11 terminal groove
12 latching hole
20 cover
21 partition wall
22 terminal hole
30 closed space forming portion
31*a*, 31*b* fixed terminal
311 fixed contact placement surface
32 movable contactor
321 first surface
322 second surface
33*a*, 33*b* fixed contact
34*a*, 34*b* movable contact
35 movable shaft
35*a* annular guard portion
36 coil spring
37 spring tray (an example of a support plate portion)
38 retaining ring
40 electromagnetic drive unit
40*a* electromagnet portion
41 spool
42 coil
43 coil terminal
44 second yoke
51 flange
52 ceramic plate
521 terminal hole
53 first yoke
531 hole
54 bottomed cylindrical body
55 permanent magnet
57 fixed iron core
58 movable iron core
59 return spring

60 attenuation mechanism unit
61 attenuation member
61*a* first vertical cylindrical portion
61*b* guard portion
61*c* second vertical cylindrical portion
62 sound insulating gap
63 collision sound attenuating unit
64 meandering portion
641 first peripheral wall portion
642 connection wall
643 second peripheral wall portion
644 third peripheral wall portion
645 connection wall
646 fourth peripheral wall portion
70 closed space
71 arc shielding member
100 electromagnetic relay

What is claimed is:

1. An electromagnetic relay comprising:

a box-shaped insulating housing in which a closed space is formed;

a pair of fixed terminals fixed to the housing electrically independently of each other and each having a fixed contact placement surface in the closed space;

a plate-shaped movable contactor having a conductivity, provided in the closed space, having a first surface which is a movable contact placement surface facing the fixed contact placement surface of the pair of fixed terminals, and movably disposed such that the first surface approaches and separates from each of the fixed contact placement surfaces of the pair of the fixed terminals;

a movable shaft that extends along a moving direction of the movable contactor to a second surface side of the movable contactor, opposite to the first surface, and is movable together with the movable contactor;

an electromagnetic drive unit housed on the second surface side of the movable contactor in the housing, and driving the movable shaft to move the movable contactor forward and backward in the moving direction; and an attenuation mechanism unit, provided in the closed space, including an insulating attenuation member disposed between the movable contactor and the electromagnetic drive unit, and a sound insulating gap provided between the attenuation member and the electromagnetic drive unit, wherein the movable shaft includes a movement restricting unit that separates from the attenuation member as the movable contactor approaches the fixed contact placement surface, and comes into contact with the attenuation member after the separation of the movable contactor from the fixed contact placement surface, so as to restrict the movement of the movable shaft in a direction in which the movable contactor separates, and wherein the attenuation member includes a collision sound attenuating unit configured to lengthen a path through which the collision sound propagates, rather than a path through which the collision sound propagates toward an outside of the housing in a state where the attenuation member and the electromagnetic drive unit are in contact without the sound insulating gap, the collision sound being generated due to the movement restricting unit of the movable shaft coming into contact with the attenuation member.

2. The electromagnetic relay according to claim 1, wherein the sound insulating gap is provided in a position at least closer to the movable shaft than the collision sound attenuating unit in a direction intersecting with the moving direction of the movable contactor.

3. The electromagnetic relay according to claim 2, wherein the collision sound attenuating unit has a U shape in a sectional view along the moving direction of the movable contactor, and includes a meandering portion that and causes a path, through which the collision sound propagates, to meander.

4. The electromagnetic relay according to claim 1, wherein the collision sound attenuating unit has a U shape in a sectional view along the moving direction of the movable contactor, and includes a meandering portion that and causes a path, through which the collision sound propagates, to meander.

5. The electromagnetic relay according to claim 4,

Wherein the attenuation member is made up of the meandering portion and a guard portion extending in a direction intersecting with the moving direction of the movable contactor and, wherein the meandering portion comprises:

a first peripheral wall portion extending along the movable shaft from the guard portion of the attenuation member, a connection wall portion extending in a direction intersecting with the movable shaft from a farther end of the first peripheral wall portion, remote from the guard portion, and a second peripheral wall portion extending along the movable shaft from a farther end of the connection wall portion from the first peripheral wall portion, in a direction opposite to the first peripheral wall portion.

6. The electromagnetic relay according to claim 5, wherein the collision sound attenuating unit includes a plurality of the meandering portions connected in series to each other.

7. The electromagnetic relay according to claim 4, wherein the collision sound attenuating unit includes a plurality of the meandering portions connected in series to each other.

* * * * *